US006505740B1

(12) United States Patent
Marlin et al.

(10) Patent No.: US 6,505,740 B1
(45) Date of Patent: Jan. 14, 2003

(54) RESEALABLE PACKAGE CONTAINING AN ORGANIC SOLVENT OR SOLUTION

(75) Inventors: Lawrence J Marlin, Lake Orion, MI (US); Raymond D Diedrich, Rochester, NY (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/856,675

(22) PCT Filed: Jul. 26, 1999

(86) PCT No.: PCT/US99/14167

§ 371 (c)(1),
(2), (4) Date: May 24, 2001

(87) PCT Pub. No.: WO00/30958

PCT Pub. Date: Jun. 2, 2000

Related U.S. Application Data

(60) Provisional application No. 60/109,853, filed on Nov. 25, 1999.

(51) Int. Cl.[7] ..... B65D 85/84; B65D 81/24; B65D 30/08

(52) U.S. Cl. ..... 206/524.5; 206/484; 206/494; 206/524.2; 206/524.3; 206/210; 383/113; 383/116; 383/66

(58) Field of Search ..... 206/449, 494, 206/484, 872, 205, 210, 524.2, 524.3, 524.5; 15/104.93; 383/113, 116, 63, 66

(56) References Cited

U.S. PATENT DOCUMENTS

| | | | | |
|---|---|---|---|---|
| 3,608,708 A | * | 9/1971 | Storandt | 15/104.94 |
| 3,980,225 A | | 9/1976 | Kan | |
| 4,085,244 A | | 4/1978 | Stillman | |
| 4,252,239 A | | 2/1981 | Spiegelberg et al. | |
| 4,570,820 A | | 2/1986 | Murphy | |
| 4,727,705 A | | 3/1988 | Zahka | |
| 5,320,217 A | * | 6/1994 | Lenarz | 206/494 |
| 5,372,429 A | | 12/1994 | Beaver, Jr. et al. | |
| 5,417,035 A | | 5/1995 | English | |
| 5,487,932 A | * | 1/1996 | Dunshee | 206/210 |
| 5,595,786 A | | 1/1997 | McBride, Jr. et al. | |
| 5,639,532 A | * | 6/1997 | Wells | 206/205 |
| 5,688,394 A | | 11/1997 | McBride, Jr. et al. | |
| 5,941,378 A | * | 8/1999 | Rose et al. | 206/205 |

* cited by examiner

*Primary Examiner*—Bryon P. Gehman
(74) *Attorney, Agent, or Firm*—Stephen D. Harper; Arthur G. Seifert

(57) ABSTRACT

A package containing an organic solvent or solution and a carrier or applicator sheet is produced from a laminated sheet material having a polypropylene surface layer that is resistant to chemical interaction with the solvent or solution. The package is formed by heat sealing the edges together and providing a resealable closure member along the top end. In one embodiment, the bottom wall is attached to the respective side wall along a seal line extending diagonally from the side edge of the side wall to the bottom edge of the side wall. The carrier sheets and solvent/solution are suitable for cleaning hard surfaces prior to applying a paint or other surface coating or for providing a "highlighting" liquid that helps detect surface finish defects and/or a temporary protective coating to prevent adhesion of weld splatter.

21 Claims, 3 Drawing Sheets

RESEALABLE PACKAGE CONTAINING AN ORGANIC SOLVENT OR SOLUTION

This application claims priority from Provisional application Serial No. 60/109,853, filed Nov. 25, 1998 and International application PCT/US99/14167, filed Jul. 26, 1999.

BACKGROUND OF THE INVENTION

The present invention is directed to a package for containing an organic solvent. Optionally, in addition to the solvent, the package may contain other materials dissolved in the solvent and/or a solid carrier such as cloth or the like that makes use of the solvent or solution contained in liquid form in the package more convenient. More particularly, the invention relates to a package made from a flexible laminated sheet material that is resistant to chemical interaction with most organic solvents.

Organic solvents, such as naphtha, acetone and various alcohols, are commonly used for cleaning hard surfaces to remove traces of dirt, grease and oils. Examples of various uses for organic solvents include the cleaning of electronic components prior to assembly, cleaning of medical instruments and cleaning of surfaces prior to applying a finish coating.

Cleaning solvents are generally used by the user by pouring an amount of the desired solvent onto an absorbent cloth or other applicator. The cloth or applicator is then rubbed onto the surface to be cleaned to remove foreign material. This approach often results in excessive amounts of the solvent being used. In addition, large amounts of the solvent are lost due to spillage and evaporation. In commercial applications, the time necessary to add the solvent to the applicator manually reduces production output and the loss of solvent increases the operating expenses to obtain the desired result.

To overcome the disadvantages of these methods of applying a solvent to a cloth by the user as needed, various prepackaged cloths or wipes have been produced. These prepackaged wipes typically include a flexible, absorbent sheet material containing a predetermined amount of a desired solvent. Most prepackaged wipes include an aqueous solvent system containing small amounts of various alcohols, humectants and moisturizers. Other solvent systems which have been used in prepackaged wipes include naphtha for cleaning metal surfaces prior to painting.

It is generally desirable to provide prepackaged wipes or towels in packages made from flexible plastic films to reduce the weight and bulk of material used to make the package and to provide simplified manufacturing procedures. Flexible containers or pouches also have the advantage of being collapsible so that as the contents are removed, the open end of the container can be folded over upon itself to reduce the overall volume of the container.

Containers and pouches made from flexible sheet materials are limited by the strength and durability of the sheet materials. Many sheet materials are not suitable as packaging materials due to their limited strength and bonding properties. In addition, the sheet materials used for the packaging of liquids must be non-reactive and impermeable to liquid and the vapors. This is of particular concern with containers for volatile or toxic solvents.

Sheet materials used for packaging materials are typically polymeric plastic films. Many polymers are soluble or swellable in certain organic solvents which limits their use in packaging organic solvents or materials, such as saturated wipes or towels, containing a solvent. Efforts to overcome the limitations of polymeric films include the manufacture of rigid containers which can contain pre-saturated wipes. Rigid containers have also been produced which contain dry wipes or towels where the ultimate consumer pours an amount of a desired solvent into the container to saturate the wipes or towels prior to use. These containers usually have a suitable outlet for removing the wipes from the container and a cover to close the container after each use.

Various laminated sheet materials have also been used for the manufacture of containers and pouches. Laminated sheet materials have the advantage of being able to include selected barrier layers to limit the permeability to certain compounds through the sheet. One example of such a package made from laminated sheet material containing saturated wipes is disclosed in U.S. Pat. Nos. 5,595,786 and 5,688,394 to McBride et al. These patents disclose a package made from nylon or a laminate of a polyester layer and a polyethylene layer. The packaging disclosed in these patents is limited by the solvent which can be contained in the package. Many solvents such as the naphtha described in the McBride et al. patents attack the laminates and cause separation and delamination of the polymeric film layers. These patents note that certain solvents cannot be used in packages made from the laminated film.

In view of the above-noted limitations and deficiencies of the prior packaging methods and materials, a continuing need in the industry exists for improved packaging.

A primary object of the present invention is to overcome and obviate at least one of the disadvantages and limitations of the prior packaging methods and containers. Accordingly, one embodiment of the present invention is directed to a package containing an organic solvent or solution where the package is economical, durable and convenient to use. Additional alternative objects of the invention, several of which are concurrently achieved by some of the preferred embodiments, are:

To provide a package that is convenient and economical to manufacture from a multi-ply laminate that is resistant to attack and delamination by most organic solvents.

To provide a flexible package for transporting and dispensing organic solvents and particularly volatile organic solvents.

To provide a resealable package containing a plurality of carrier sheets containing an organic solvent contained within the carrier sheets.

To provide an effective package for minimizing the release of volatile organic compounds into the atmosphere.

To provide a flexible package for aggressive organic solvents, such as alcohols, ethers, esters and acetates that cannot normally be packaged in containers made from polymeric films.

To provide a method of cleaning a hard surface using a carrier sheet containing an organic solvent, where the carrier sheet and solvent are dispensed from a resealable, flexible package.

To provide a convenient method and article for applying to a solid surface a liquid particularly adapted to "highlighting" any small blemishes in the uniformity of the finish of the solid surface.

To provide a convenient method and article for applying to a solid surface a film of liquid that will prevent the adhesion to the surface of hot metal particles, such as those commonly known as "weld splatter" that are introduced into the ambient atmosphere during conventional arc welding.

To provide a package of pre-saturated carrier sheets containing a volatile organic solvent where the carrier sheets can be removed from the package and the package reclosed to prevent evaporation of the solvent remaining in the package.

BRIEF SUMMARY OF THE INVENTION

The objects and advantages of the invention are basically attained by providing a reclosable package comprising a flexible, laminated sheet material folded to form the package, which has a bottom wall and first and second side walls each having a top end. The side walls have longitudinal side edges which are attached together along the side edge of the opposing side wall. The bottom wall is folded to form a gusset extending transversely to the side edges of the bottom wall. The bottom wall is attached to the respective side wall along a seal line extending diagonally from the side edge of the side wall to the bottom edge of the side wall. The side edges of the bottom wall in some embodiments are also attached to the side edges of the side walls to form a closed bottom container. The laminated sheet material is preferably a sheet material having an outer ply of polypropylene and an inner layer of a metal foil. The polypropylene is particularly desirable since it is resistant to chemical interaction and enables the edges of the side and bottom walls to be heat sealed together.

The package sometimes contains at least one and preferably a plurality of porous carrier sheets of suitable material or other applicators carrying an organic solvent or solution, which may be a single chemical substance or a mixture or two or more chemical substances, absorbed in the carrier sheet. The solvent or solution includes at least one chemical substance selected from the group consisting of ketones, esters, ethers, alcohols, hydrocarbons, glycol ethers and esters of glycol ethers, and unsubstituted hydrocarbons. A closure member is attached to the top end of the package for closing the package after removing one or more of the carrier sheets.

The objects and advantages of the invention are further attained by providing a package comprising a flexible sheet material folded to form a package having first and second sides, a bottom end and top end, the sheet material being a laminated metal foil having an outer polypropylene face forming an inner surface of the package. The package contains at least one organic solvent substance as detailed in the preceding paragraph. The sheet material used to form the package is resistant to attack and delamination by the solvents.

Some objects, advantages and other salient features of the invention will become more apparent in view of the following detailed description of the invention and the annexed drawings which form part of this original disclosure.

DETAILED DESCRIPTION OF THE INVENTION

The present invention is directed to a container in the form of a package or pouch for containing an organic solvent or solution and/or a carrier containing a predetermined amount of a solvent or solution. More particularly, the invention is directed to a flexible package that is resealable, resistant to delamination by the solvents, and effective for long term storage and shipping of organic solvents and organic solvent-containing materials.

Figure 1:
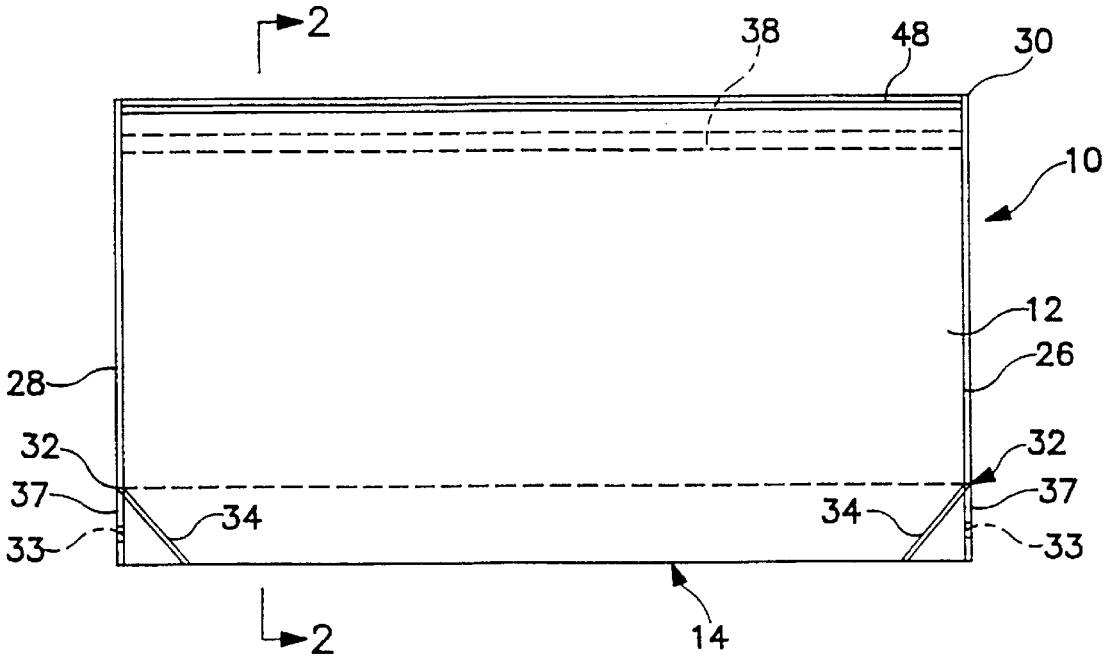
FIG. 1 is a side elevational view of the package in a preferred embodiment of the invention showing the package in an empty and flat condition.
Figure 2:
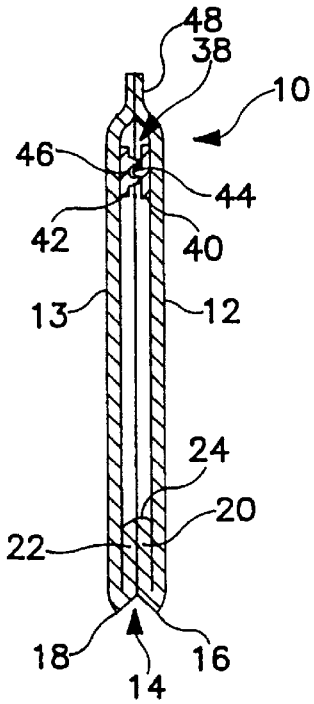
FIG. 2 is a cross-sectional view of the package taken along lines 2—2 of FIG. 1.

In a preferred form of the invention, the package 10 as shown in FIGS. 1–7 is a bag-like container made of a flexible sheet material that can be bonded together along its seams to form a closed package. Referring to FIGS. 1 and 2, an empty package 10 is illustrated which is preferably made from a single sheet of a suitable chemical resistant sheet material. The sheet material is cut to form a blank and is then folded to define two opposing side walls 12 and 13, and a bottom wall 14 connecting the side walls 12 and 13 together along parallel fold lines 16 and 18 as shown in FIG. 2. Bottom wall 14 is folded into two equal bottom panels 20 and 22 along a center fold line 24 as shown in FIG. 2.

The package 10 is formed by bonding the edges of the side walls 12 and 13 together along edge seams 26 and 28. In preferred embodiments, the edges of the side walls 12 and 13 are heat sealed together to form seams 26 and 28 along a first portion extending from a top end 30 to the point 32 where the side walls 12 and 13 overlie the bottom panels 20 and 22, respectively. The bottom panels 20 and 22 each include a notch 33 cut from the respective side edges so that when the bottom panels are folded to the position shown in FIGS. 1 and 2, small areas of the inner surface of the side walls 12 and 13 are exposed. The notches of the bottom panels 20 and 22 are aligned so that the exposed areas are superimposed on one another. The inner surface of the side panels 12 and 13 exposed through the notches 33 are heat sealed together at 35 so that the opposing side walls are attached together at the bottom end of the package 10. The bottom panels 20 and 22 are heat sealed along diagonal seams 34 and 36 of the respective side walls, as shown in FIG. 1, to form gussets.

In some preferred embodiments, the heat sealed seams 34 and 36 extend at an angle of about 45° from the edge of the side walls to the respective fold lines 16 and 18. A second portion of the side edges of the side walls which overlie the respective bottom panel optionally can be sealed together along a seam 37.

In preferred embodiments of the invention, package 10 includes a closure member 38 capable of sealing the package closed after opening. In the embodiment illustrated, closure member 38 is a pair of interlocking strips 40 and 42 attached to the inner surface of the side walls 12 and 13. The interlocking strip 40 includes a ridge 44 and the interlocking strip 42 includes a complementing recess 46. As shown in FIG. 2, the ridge 44 snaps into the recess 46. Preferably, the closure member 38 is made of a flexible polymeric material so that the closure can be repeatedly opened and closed. As shown in FIG. 1, the closure member 38 extends across the entire open top end of the package so that the package can be closed to prevent evaporation of the contents and opened to remove or add contents to the package.

The package 10 is suitable for containing a variety of solid or liquid materials. In preferred embodiments of the invention, the package 10 contains a solvent or other liquid. Typically, the top end of the package is heat sealed along a seam 48 after the package is filled to prevent leakage during shipping. The consumer is then able to cut the heat seal 48 from the top end to expose the closure member 38. In further embodiments, a tear strip as known in the art can be used to seal the package closed and which can be opened by the user. The closure member 38 can then be pulled open to access and remove the contents and reclose the package to prevent evaporation of the solvent. In a preferred form of the invention, the contents are placed in the package and then the package is hermetically sealed until opened by the consumer.

The solvents contained in the package are preferably highly effective solvent systems for cleaning hard surfaces and particularly metal surfaces in the preparation for painting or the application of other finish coatings. The preferred solvent systems are effective in removing a variety of polymeric materials such as adhesives and lubricants from a surface with little or no residue. The most effective organic solvents for removing adhesives or other materials from metal surfaces are typically reactive with many polymers and therefore difficult to package in polymeric containers. Generally, such aggressive solvents are stored and shipped in metal containers. Most polymeric plastic materials, such as polyethylene, are not able to withstand prolonged contact with these solvents and result in the container leaking. In addition, most conventional laminated packaging materials are not able to tolerate extended contact with aggressive solvents since the solvent often attacks one or more layers of the laminate, and particularly the adhesive layers resulting in delamination of the laminate.

In preferred embodiments of the invention, the package is made from a sheet material having a heat sealable surface layer that is resistant to attack by the solvents. A particularly preferred sheet material is a laminate having an inner metal foil ply and a layer of polypropylene forming at least one outermost layer of the laminate. Although polypropylene is generally difficult to work with during manufacture of the package, the polypropylene layer has been found to be sufficiently heat sealable using heat sealing machines, resistant to most organic solvents and provide an effective odor barrier for highly volatile solvents.

The polypropylene may be selected, based on the aforestated criteria, from among any of the homopolymers and copolymers of propylene monomer known in the art as well as blends or interpolymers or the like of such materials with other polymers (particularly other thermoplastics). Polypropylenes are described, for example, in the chapter entitled "Propylene Polymers" in Volume 13 of the Encyclopedia of Polymer Science and Engineering, Second Edition, 1988, published by John Wiley and Sons, Inc.

Figure 3:
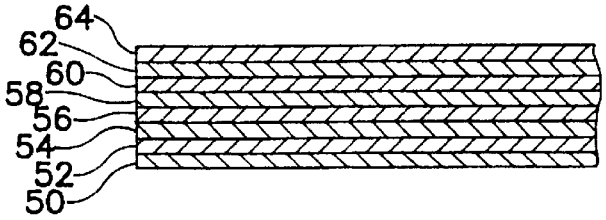
FIG. 3 is a cross-sectional view of the laminate for making the package of FIG. 1.
Figure 4:
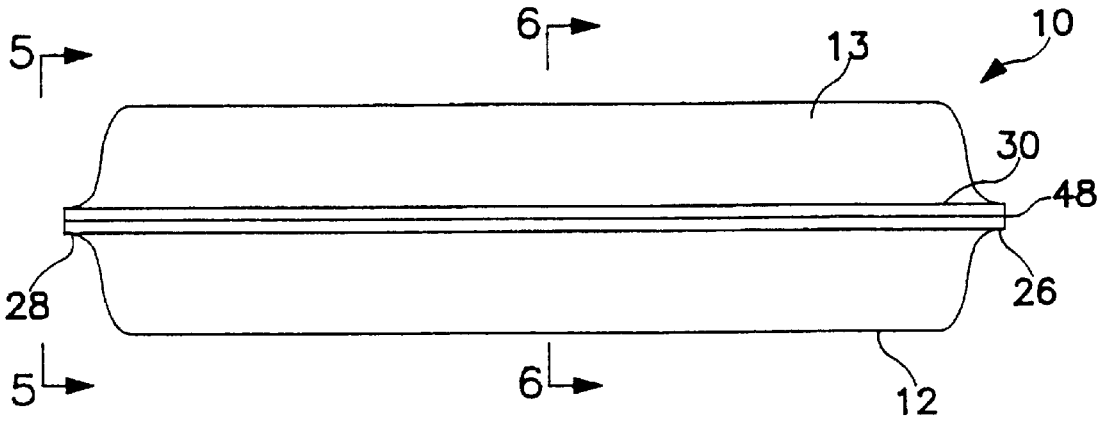
FIG. 4 is a top plan view of the package in a preferred embodiment of the invention containing a stack of carrier sheets.

Referring to FIG. 3, an example of a preferred laminated sheet material is shown in cross-section which includes a first layer 50 of polypropylene forming the inner face of the finished package. The first layer 50 is generally a cast polypropylene layer having a thickness of about 60 microns. An adhesive layer 52 bonds the polypropylene layer 50 to a polyamide layer 54 having a thickness of about 15 microns. The adhesive, which is typically a polyurethane, is applied at a coverage of about 3.0 g/m$^2$. A second polyurethane adhesive layer 56 is applied onto the polyamide layer 54 at a coverage of about 3.0 g/m$^2$ to bond the polyamide layer 54 to a 9.0 micron aluminum foil 58. A polyurethane adhesive layer 60 is applied over the aluminum foil layer 58 at a coverage of about 3.0 g/m$^2$ followed by a print layer 62. Polyurethane adhesives are generally preferred since these have been found to be resistant to many solvents. The print layer 62 having suitable coloring and indicia is applied having a coverage of about 2.0 g/m$^2$. A final outer top layer 64 of a polyester is applied over the print layer 62. The polyester layer generally has a thickness of about 12 microns. An example of a suitable laminate is commercially available from Danisco Flexible Schupbach AG of Burgdorf, Denmark. Other suitable laminated sheet materials are available from Facile Holdings Company of New Jersey.

Closure member 38 in preferred embodiments is a zipper-like closure made of polypropylene. The polypropylene closure is particularly desirable since it is compatible with the laminate of FIG. 3 and can be readily heat sealed to the polypropylene layer of the laminate. The polypropylene closure is also desirable since it is resistant to attack from the organic solvents contained in the package. A preferred resealable closure member is a polypropylene/polyethylene blend made by Presto Products Company and sold under the trade designation Presto 127. In further embodiments, other forms of closures can be used so long as the closure is resistant to the solvent system and can be securely attached to the laminate. Preferably, the closure is capable of repeated opening and closing to provide effective sealing of the package. Examples of suitable closures include a flexible wire attached to the top end of the package so that the top end can be folded over and secured in place by folding the wire around the sides of the package.

Figure 5:
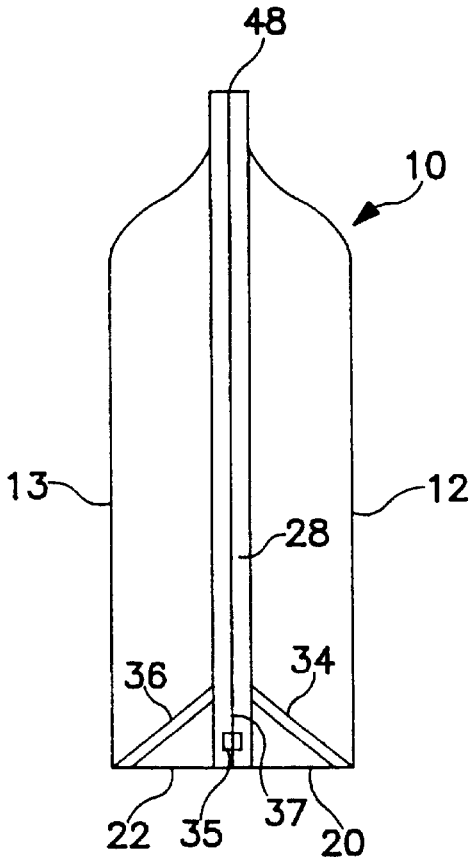
FIG. 5 is an end view of the package of FIG. 4 taken along line 5—5 of FIG. 4.
Figure 6:
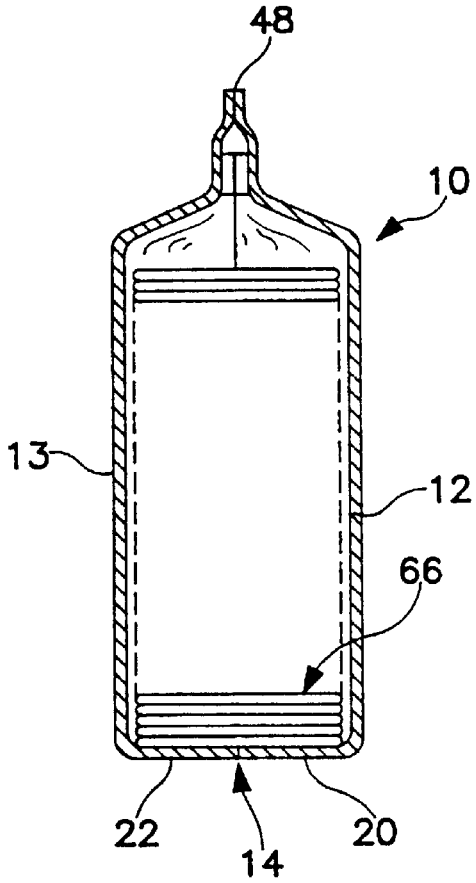
FIG. 6 is a cross-sectional view of the package taken along line 6—6 of FIG. 5.
Figure 7:
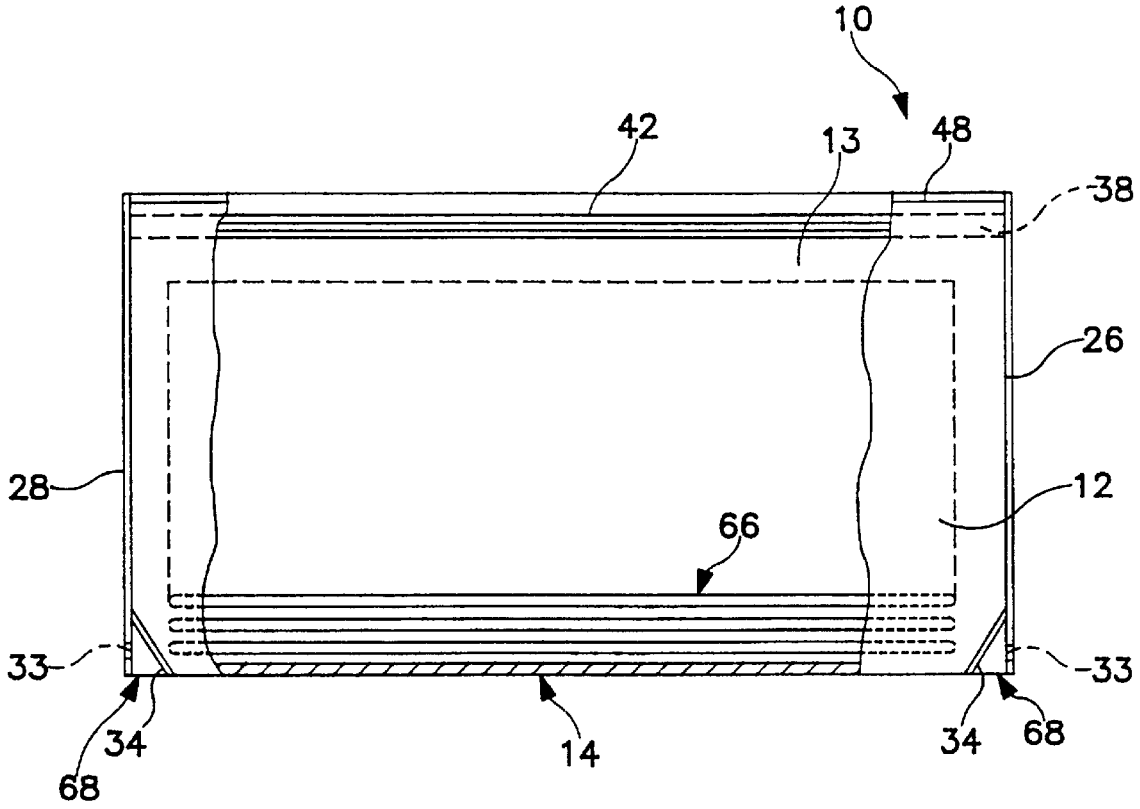
FIG. 7 is a side elevational view in partial cross-section of the packaging showing the stack of carrier sheets.

Referring to FIGS. 4–7, the package 10 in preferred embodiments includes a stack of carrier sheets 66 containing the desired solvent or solution. The package 10 is expandable to receive the carrier sheets 66 where the bottom panels 20, 22 fold downwardly to produce a flat bottom 14 as shown in FIGS. 5–7. The ends of the bottom panels are attached to the side walls along diagonal seal lines 34 and 36 and form gussets 68 which enable the package to stand upright by itself without assistance of an external rack or support system. During manufacture, the carrier sheets 66 are placed in package 10 and a predetermined amount of solvent or solution is poured onto the carrier sheets 66 to saturate the sheets. Alternatively, the carrier sheets 66 can be saturated with the solvent or solution prior to inserting into the package. The package is then closed and the top end heat sealed at 48 to hermetically seal the package. Alternatively, the carrier sheets 66 can be inserted into the package, the package then closed, the top end of the package heat sealed, the solvent or solution then introduced into the interior of the package through a pre-existing or newly made hole in the package, and a solvent-resistant patch applied over the hole in the package and sealed to other parts of the package so that the entire package is again hermetically sealed. In one preferred version of this alternative embodiment, the patch is a label for the package contents and is attached to the remainder of the package by a pressure sensitive adhesive backing on the label. The package is illustrated as containing sheet materials, although it will be appreciated that other carriers or solvent applicators can be used.

The carrier sheets 66 are made of a suitable absorbent sheet material commonly used for wipes or towels for cleaning various surfaces. One example of a suitable carrier sheet is a melt blown polypropylene which has sufficient wet strength and resistance to the solvents for most applications.

The carrier sheets in the embodiment shown in FIGS. 6 and 7 are stacked in a horizontal fashion with the height of the stack being limited only by the height of the package. It will be appreciated by one skilled in the art that the carrier sheets can be stacked in any fashion or wound into a continuous roll where the carrier sheets are separable by frangible tear lines. The orientation of the carrier sheets is limited only by the ability of the sheets to be removed from the package individually as needed by the user. The dimensions of the carrier sheet is selected for the intended use of the sheet. Similarly, the overall dimensions of the package can be selected for the size of the carrier sheets and the quantity of sheets to be contained therein. By way of example, a suitable package can be about 13 inches long, about 13 inches tall, and 4 inches wide.

In preferred embodiments, the carrier sheets are any flexible woven or non-woven sheet material having sufficient wet strength during use and that does not interact with the solvent or solution system or the surface being cleaned. The carrier sheets are dimensioned appropriately for the intended use and can be stacked flat or folded into a variety of configurations as known in the art of packaging sheet materials. In further embodiments, other applicators such as a felt pad, can be used.

The carrier sheets can be single or multi-ply sheets made of various materials depending on the solvent or solution system. The sheet material can be, for example, spunbonded polypropylene, high density polyethylene, ethylene vinyl acetate copolymers, vinyl acetate or cellulosic materials. The sheets can be manufactured using standard sheet forming processes including, for example, weaving, needle punching or staple carding processes.

The solvent system is generally a mixture of solvents and cosolvents that are blended according to the particular intended use. In one embodiment, the solvent is formulated to be a degreasing solvent for preparing metal surfaces prior to painting. In preferred embodiments for cleaning, the solvents are organic solvents that contain little or no water other than whatever amount may be absorbed from the atmosphere during handling of the solvents and/or may form an azeotrope with the solvent.

The chemical nature of the solvent or solution should be selected to suit the intended use. For one major area of use of the invention, the removal of excess amounts of currently commercially used seating compounds during manufacture of automobile bodies, the preferred solvents are ketones and esters, both of which may contain other functional groups in addition to their characterizing ones as ketones or esters; hydrocarbons; and mixtures thereof. Examples of preferred ketones include acetone, methylethyl ketone, methyl isobutyl ketone and cyclohexanone. Preferred esters include ethyl acetate, n propyl acetate, isopropyl acetate, and the three butyl acetates. Preferred hydrocarbons include aromatic and aliphatic hydrocarbon solvents that are readily and inexpensively available as fractions from the distillation and refining of petroleum, more specifically petroleum naphtha, kerosine, petroleum ether, and light aromatic hydrocarbons such as toluene and the three xylenes, and further include other solvents of natural origin such as turpentine, pinene, and limonene.

Among other suitable solvents are: ethers that can include diethyl ether, methylethyl ether and butyl ether; lower alkyl alcohols, such as methanol, ethanol, butanols, and propanols; low molecular weight poly(ethylene glycol)s; other di- or tri-functional solvents such as the mono-methyl, -ethyl, -propyl, and -butyl ethers of propylene glycol, ethylene glycol, diethylene glycol, dipropylene glycol, and the acetate esters of all of these mono-ethers of glycols and diglycols. A solvent mixture can also include small amounts of various additives, such as surface active agents and vapor pressure suppressing agents, which are not effective solvents by themselves.

In use, the packaged carrier sheets and solvent or solution system are selected for the particular task and the surface to be cleaned and the materials to be removed from the surface. In one preferred embodiment, the carrier sheets are used as part of a method to clean metal surfaces prior to applying a paint or other surface coating. The user separates the heat sealed seam from the top end of the package and separates the closure members to open the package. A desired number of carrier sheets or other applicators are removed from the package and the package is resealed by pressing the closure members together. The carrier sheets are rubbed onto the work surface to clean the surface and remove all foreign materials such as adhesives, grease, and the like. The spent carrier sheets are then discarded in a suitable receptacle.

In another preferred embodiment, the liquid in the carrier sheets is especially suited for providing a glossy surface to facilitate the visual detection of small scale surface shape irregularities, commonly called "dents" and "dings", in shaped metal surfaces that are intended eventually to have a glossy finish, but have not yet reached that stage of their processing, and/or for inhibiting the adhesion of small amounts of hot metal, commonly called "weld splatter", on nearby surfaces during welding of metal objects. Contrary to the preferences noted above when cleaning is the primary object, for this specialized preferred embodiment (denoted hereinafter as "HL-WSAP" for "HighLighting-Weld Splafter Adhesion Prevention"), this liquid in the package for this purpose generally contains from 85 to 50% by weight of water. More particularly, this liquid preferably comprises, more preferably consists essentially of, or still more preferably consists of, water and:

(A) from 1.0 to 60% by weight of polyethylene glycol having a weight average molecular weight in the range from 200 to 500:

(B) from 0.5 to 15.0% by weight total of low foaming non-ionic and/or nonstaining anionic surfactant, preferably free from fluorine;

(C) a corrosion inhibiting amount of corrosion inhibitor; and, optionally, one or more of:

(D) from 0.3 to 10% by weight total of low foaming amphoteric surfactant, preferably free from fluorine;

(E) from 0.001 to 2% by weight of a low or moderate foaming fluorosurfactant ("fluorosurfactant" is used herein to mean any surfactant containing at least one fluorine atom per molecule);

(F) 0 to 1% by weight of a rheology modifying agent; and (G) 0 to 59% by weight of polyethylene glycol having a weight average molecular weight of 600 or higher, preferably from 1000 to 10,000, or more preferably from 4,000 to 8,000, except that the total of components (A) and (G) should not exceed 60% by weight.

As used herein, the term "low foaming surfactant" denotes a surfactant which produces less than 60/30 mm of foam according to the shaking test method described below, while the term "moderate foaming surfactant" denotes a surfactant which produces more than 60/30 but less than 100/60 mm of foam according to the same shaking test method.

Shaking Test Method

A glass stoppered 250 milliliter measuring cylinder, about 30 millimeters in diameter, is filled to the 150 milliliter mark with a 0.1% by weight solution in water at room temperature of the surfactant to be tested. The measuring cylinder is stoppered and then vigorously shaken for 30 seconds. The foam height immediately after shaking is measured, and the foam height is measured again 30 seconds after shaking is completed. A foam height of 60 millimeters or less after shaking or 30 millimeters or less 30 seconds after shaking indicates a low foam surfactant. A foam height that does not indicate a low foam surfactant but is not more than 100 millimeters immediately after shaking or not more than 60 millimeters 30 seconds after shaking indicates a moderate foaming surfactant.

The metal surfaces treated according to the HL-WSAP embodiment of this invention are preferably selected from the group consisting of cold rolled steel, hot-dip and electrogalvanized steel, other zinc alloy coated steels, zinc and its alloys that contain at least 80 atomic % of zinc, aluminum, and aluminum alloys that contain at least 45 atomic percent of aluminum.

When an article according to this invention is to be used for highlighting, optional component (G) is preferably omitted or kept to a very low amount, because it decreases the gloss obtained with the composition. However, for inhibition of adhesion of weld splatter, optional component (G) is preferably included in most cases, because it provides a mechanically tougher film that offers better protection against corrosion during short term storage. Also, when a composition according to this invention is to be used for highlighting, component (D) is preferably included in order to guard against any loss of gloss because of phase separation. When the composition is to be used for weld splatter adhesion inhibition, however, component (D) is less important although not at all harmful.

Polyethylene glycols sold by Dow Chemical Company under the trade name of POLYGLYCOL E and by BASF under the trade name PLURACOL are useful in the practice of the the HL-WSAP embodiment of invention. Polyethylene glycols have the formula:

$$H(OCH_2CH_2)_nOH,$$

and those where n on average is in the range of about 4 to about 11 are useful for component (A) of a liquid composition to be used in the HL-WSAP embodiment of the invention. In the commercially available polyethyleneglycols the trade name is usually followed by a number which corresponds to the average molecular weight of the product. For example, for PEG 400, n=8.2–9.1, and the molecular weight, which is to be understood herein as weight average molecular weight, would be about 400. A polyethylene glycol with an average molecular weight of about 400 is preferred in the practice of the HL-WSAP embodiment of the invention due to low volatility and ready availability. Polyethylene glycol 200 (n=4) and polyethylene glycol 300 (n=6) also are useful. Polyethylene glycol with a molecular weight above about 500 (n=11) can be used in addition to those of lower molecular weight, but they impart a waxy, hazy appearance to the applied coating when dried if present in substantial amounts. This tends to frustrate the purpose of a highlighting composition, but does not harm weld splatter inhibition. For a composition intended for the latter purpose, a PEG with a molecular weight of 6000 is most preferred for component (G).

The liquid composition used in the HL-WSAP embodiment of the invention usually comprises low foaming nonionic surfactant, and, optionally, a low foaming amphoteric surfactant and/or a low or moderate foaming fluorosurfactant. Anionic surfactants can be utilized in a liquid composition for the HL-WSAP embodiment of the invention in lieu of nonionic surfactants. Sulfated or sulfonated anionic surfactants, when present in amounts above 2–5% by weight of the composition, can cause staining and etching of the metal surfaces and therefore should be avoided. However, other anionic surfactants, such as carboxylates and phosphates, can be used at high concentrations without staining or etching the metal surfaces. Nevertheless, component (B) is preferably selected from nonionic surfactants only. Examples of commercial surfactants useful for component (B) include TRITON® CF-54 (modified polyethoxy adduct), TRITON® DF12 (modified polyethoxylated linear alcohol), and TRITON® DF-16 (a terminated ethoxylated linear alcohol), all products of Union Carbide Corporation; MAKON® NF-12 (an alkylphenoxypolyoxyethylene alcohol) manufactured by Stepan Company; and PLURONIC® L62 (a polyoxyethylene polyoxypropylene block copolymer) manufactured by BASF Wynadotte Corporation.

Amphoteric and ampholytic surfactants have been found to be highly preferred in the HL-WSAP embodiment of the invention directed to highlighting. The hydrotroping (coupling) and wetting properties of the amphoteric and ampholytic surfactants make them particularly valuable. Typical useful amphoteric surfactants include the following commercially available products: MONATERIC® CyNa50, a 50% active solution of the sodium salt of 2-caprylic-1-(ethyl beta oxypropionic acid)-imidazoline by Mona Industries, and ALKAWET® LF, a proprietary amphoteric surfactant blend manufactured by Lonza.

Fluorosurfactants when present at low levels substantially enhance the wetting properties of the liquid composition used in the HL-WSAP embodiment of the invention. The fluorosurfactants can be nonionic or anionic. Preferably the fluorosurfactant is a low to moderate foaming surfactant. Examples of useful commercially available fluorosurfactants include FLUOWET® PL80, a mixture of perfluorinated phosphinic and phosphonic acids, and FLUOWET® OTN, a fluoroaliphatic oxyethylate, products of Hoechst Celanese Corporation.

A liquid composition used in the HL-WSAP embodiment of the invention should rapidly wet and form a foam-free film on the surface of the metal to which it is applied. Satisfactory highlighting performance has been observed with coatings having an areal density (mass per unit area) of from 0.1 to 100 grams per square meter (hereinafter often abbreviated as "$g/m^2$"). Normally, however, for either highlighting or prevention of weld splatter adhesion, an areal density within the range from 20–50 $g/m^2$ is preferred. Any surfactant combination can be used as long as the foam rapidly dissipates and the combination of surfactants does not contribute to staining and etching of the metal surface upon contact for extended periods.

Another requirement of a liquid composition for the HL-WSAP embodiment of the invention is that it must not cause or allow corrosion of the metal to which it is applied, at least during the period of contact with the metal. Red rust on ferrous metals and white rust on aluminum and zinc containing metal substrates prevent application of a suitable phosphate coating or subsequent organic coating (paint). In order to avoid such problems, the liquid composition for the HL-WSAP embodiment of the invention must contain a corrosion inhibitor. The preferred corrosion inhibitor comprises a combination of an alkali metal borate, preferably sodium or potassium borate and most preferably potassium borate, and a complex carboxylic acid. Ammonium borate is not desirable as a corrosion inhibitor in general purpose formulations for the HL-WSAP embodiment of the invention because it causes staining of zinc and its alloys. An alkali metal borate is preferred in combination with an alkali metal, preferably sodium or potassium, neutralized complex carboxylic acid composition. The complex carboxylic acids preferably comprise, or more preferably consist of, a mixture of branched chain monocarboxylic acids and amino monocarboxylic acids. A suitable commercially available product to supply this part of the preferred corrosion inhibitor is HOSTACOR® TP-2291 from Hoechst Celanese Corporation.

The corrosion inhibitor most preferably is a combination of the borate and complex carboxylic acids. However, other corrosion inhibitors, such as sodium nitrite and alkanolamines such as ethanolamine, diethanolamine, triethanolamine and the like can be used. The combination of borate and complex carboxylate is preferred due to its lack of carcinogenic propensity and its mildness to the skin.

For ease of application, it is sometimes advantageous to adjust the rheological properties of a liquid composition for the HL-WSAP embodiment according to the invention. For example, vertically arranged surfaces may require a rather viscous composition in order to remain on the vertical surface for a sufficient length of time to permit any foam to dissipate and permit the visual inspection to be made. Known Theological modifying agents such as gums and crosslinked acrylic copolymers are useful for this purpose. Preferred rheological modifying agents include ACCUSOL® 810, a crosslinked acrylic co-polymer product of Rohm and Haas Company, and xanthan gums such as KEL-ZAN™ brand xanthan gum manufactured by Kelco Division of Merck and Company.

A liquid composition for the HL-WSAP embodiment of the invention preferably has a pH in the range from 7 to 12, more preferably from 8 to 11, and still more preferably from 8.5 to about 10.5.

A preferred liquid composition for the HL-WSAP embodiment of the invention for application to metal for highlighting comprises, more preferably consists essentially of, or still more preferably consists of, water and:

(A) from 1.0 to 60% by weight of a polyethylene glycol with a molecular weight in the range from 200 to 500;
(B) from 0.5 to 15% by weight of low foaming unfluorinated nonionic surfactant;
(C) a corrosion inhibiting amount of a combination containing alkali metal borate and a neutralized mixture of complex carboxylic acids;
(D) from 0.3 to 10% by weight of low foaming unfluorinated amphoteric surfactant;
(E) from 0.001 to about 2% by weight of a fluorosurfactant; and
(F) up to 1% by weight of a rheological property modifier and has a pH in the range from 7.5 to 11. In this composition or in any other liquid composition for the HL-WSAP embodiment of this invention, component
(D) preferably consists of (i) from 0.1 to 5.0, or more preferably from 0.3 to 3.0,% by weight of an alkali metal borate and (ii) from 0.05 to 5.0, or more preferably from 0.1 to 1.5, % by weight of salt of complex carboxylic acids, these percentages being referred to the entire liquid composition.

A still more preferred liquid composition for the HL-WSAP embodiment of the invention comprises, more preferably consists essentially of, or still more preferably consists of, water and:

(A) from 5 to 25% by weight of polyethylene glycol with a molecular weight of from 200 to 400;
(B) from 1 to 10% by weight of low foaming unfluorinated nonionic surfactant;
(C) from 0.3 to 3% by weight of potassium borate and from 0.1 to about 1.5% by weight of alkali metal salts of complex carboxylic acids;
(D) from 1 to 7% by weight of low foaming unfluorinated amphoteric surfactant;
(E) from 0.05 to 0.5% by weight of fluorosurfactant; and
(F) from 0.05 to about 0.6% of rheological modifier and has a pH in the range from 8.5 to 10.5.

The liquid highlighter compositions and articles as described above are also suitable for inhibiting the adherence of weld splatter. However, as already noted, for this particular purpose optional component (G) is preferably included in the composition. The ratio of the amount of component (G) to component (A) in a liquid for weld splatter adhesion inhibition preferably is in the range from 10:1 to 1:1, or more preferably in the range from 4.0:1.0 to 2.1:1.0.

It is preferred, in order to minimize adverse environmental impacts and/or the cost of preventing such adverse environmental impacts, that liquid compositions for the HL-WSAP embodiment of the invention as defined above should be substantially free from certain ingredients, some of which have been used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, or 0.001 percent by weight of each of the following constituents: hexavalent chromium; divalent and higher than divalent metal cations; and any organic materials defined as VOC's by antipollution laws, including but not limited to, hydrocarbons and halohydrocarbons, alcohols, aldehydes, ketones, ethers, carboxylic acids, and esters having a vapor pressure in excess of 10 millibars at 25° C.

The package of the present invention is also suitable for containing a solvent or other liquid without a carrier or applicator. In this embodiment, the solvent or solution is hermetically sealed and can be opened by cutting or tearing along a tear line. The solvent or solution can be transferred to another container for use by the consumer. The package can be provided with a suitable pouring spout and reclosable closure member, such as a threaded cap, to close the package after a desired quantity has been dispensed.

The package is primarily intended to be disposable when the carrier sheets have been used. The sheet material of the package is sufficiently flexible and durable to be reused. In addition, the package satisfies the packaging requirements for the U.S. Department of Transportation.

While various embodiments have been selected to illustrate the invention, it will be apparent to those skilled in the art that various additions and modifications can be made without departing from the scope of the invention as defined in the appended claims.

What is claimed is:

1. A reclosable package comprising:

(a) a flexible laminated sheet material folded to form a bottom wall, first and second side walls and a top end, said side walls having a bottom end and a top end, said bottom wall and said side walls each having longitudinal side edges, a first portion of said longitudinal side edges of said first side wall being bonded to a first portion of said longitudinal edges of said second side wall, and said bottom wall being bonded to said first and second side walls along a sealing line extending diagonally from a respective side edge to a bottom edge of said side wall, wherein said laminated sheet material comprises (i) a metal foil layer that is sandwiched between two layers of non-metallic material and (ii) a polypropylene layer forming an inner surface of said package;

(b) at least one porous carrier sheet material contained in said package;

(c) an organic solvent absorbed on said at least one porous carrier sheet material, wherein said organic solvent is a solvent selected from the group consisting of ketones, acetates, esters, ethers, hydrocarbons, alcohols, and mixtures thereof; and (d) a closure member coupled to said top end of said side walls for separately closing and hermetically sealing said top end of said package.

2. The package of claim 1, wherein said closure member is heat sealed to said polypropylene layer.

3. The package of claim 2, wherein said closure member is a polypropylene closure member.

4. The package of claim 2, wherein said closure member comprises two opposing interlocking members.

5. The package of claim 1, wherein said bottom wall includes first and second bottom panels, said first bottom panel having outer edges heat sealed to edges of a second portion of said first side wall, and said second bottom panel having outer edges heat sealed to edges of a second portion of said second side wall to form a gusset for supporting said package in an upright position.

6. The package of claim 5, wherein said longitudinal edges of said side walls are heat sealed together.

7. The package of claim 1, wherein said first and second side walls are heat sealed along said top end of said package closing said top end.

8. The package of claim 1, wherein said laminated sheet material comprises an outer layer of a polyester.

9. The package of claim 1, wherein said laminated sheet material is a polyester, aluminum foil, polyamide and polypropylene laminate.

10. A packaged organic solvent comprising:

(a) a flexible sheet material folded to form a package having first and second side walls, a bottom wall and a top end, wherein said sheet material is a laminated metal foil having a polypropylene surface forming an inner surface of said package and wherein a first length of said each side edge of said first side wall is heat sealed to a first length of said side edges of said second side wall to define a substantially tubular shaped section, and wherein a second length of each side edge of said first side wall is heat sealed to said bottom wall, and a second length of each side edge of said second side wall is heat sealed to said bottom wall; and (b) at least one organic solvent containing a compound selected from the group consisting of ketones, acetates, esters, ethers, hydrocarbons, alcohols, and mixtures thereof, wherein said flexible sheet material is resistant to attack and delamination from said at least one organic solvent.

11. The package of claim 10, further comprising a resealable closure member attached to said top end of said package.

12. The package of claim 11, wherein said closure member is heat sealed to said polypropylene surface.

13. The package of claim 11, wherein said closure member is a polypropylene closure member.

14. The package of claim 11, wherein said closure member comprises two opposing interlocking members.

15. The package of claim 10, wherein said side walls are heated sealed to said bottom wall along a seal extending diagonally from said side edges of said side walls to a bottom edge of said side wall.

16. The package of claim 10, wherein said second length of said side edges of said side walls are heat sealed together.

17. The package of claim 10, wherein said first and second side walls are heat sealed along said top end of said package closing said top end.

18. The package of claim 10, wherein said sheet material comprises an outer layer of a polyester.

19. The package of claim 10, wherein said sheet material is a polyester, aluminum foil, polyamide and polypropylene laminate.

20. The package of claim 10, further comprising a plurality of absorbent carrier sheets contained in said package and having said organic solvent contained therein.

21. The package of claim 20, wherein said carrier sheets are made of polypropylene.

* * * * *

UNITED STATES PATENT AND TRADEMARK OFFICE

CERTIFICATE OF CORRECTION

PATENT NO. : 6,505,740 B1
DATED : January 14, 2003
INVENTOR(S) : Marlin et al.

It is certified that error appears in the above-identified patent and that said Letters Patent is hereby corrected as shown below:

Title page,
Item [60], Related U.S. Application Data, delete "1999", and insert therefor
-- 1998 --.

Signed and Sealed this

Second Day of September, 2003

JAMES E. ROGAN
*Director of the United States Patent and Trademark Office*